United States Patent [19]

Goto et al.

[11] 4,060,411

[45] Nov. 29, 1977

[54] PRECIPITATION-HARDENABLE, NITRIDED ALUMINUM ALLOYS AND NITRIDED MOTHER ALLOYS THEREFOR

[75] Inventors: Mituhiro Goto, Tokyo; Isao Hashimoto, Ichikawa; Shugo Watanabe, Tokyo; Koji Itabashi, Kitamoto, all of Japan

[73] Assignee: Mamiya Koki Kabushiki Kaisha, Otsuka, Japan

[21] Appl. No.: 656,601

[22] Filed: Feb. 9, 1976

[30] Foreign Application Priority Data

Feb. 26, 1975 Japan ..... 50-23529
Feb. 26, 1975 Japan ..... 50-23530

[51] Int. Cl.[2] ..... C22C 1/02; C22C 1/03; C22C 21/00

[52] U.S. Cl. ..... 75/138; 75/68 R; 75/139; 75/141; 75/142; 75/144; 75/146; 75/147; 148/32; 148/32.5

[58] Field of Search ..... 75/138, 135, 68 R, 146, 75/147, 139, 141, 142, 144; 148/32, 32.5

[56] References Cited

U.S. PATENT DOCUMENTS 3,531,337 9/1970 Kawakatsu ..... 75/138
3,551,143 12/1970 Marukawa et al. ..... 75/138

*Primary Examiner*—R. Dean
*Attorney, Agent, or Firm*—Armstrong, Nikaido & Marmelstein

[57] ABSTRACT

Precipitation-hardenable, nitrided aluminum alloys are produced by forming an alloy of aluminum metal at a temperature up to about 800° C with a nitrided mother alloy of a specified composition which has been nitrided at a temperature of 800° to 1,200° C. The aluminum alloys are made precipitation-hardenable by the incorporation therein of a precipitation-hardening component such as copper, zinc and/or magnesium, and the precipitation-hardening component can be contained in the mother alloy undergoing nitridation.

8 Claims, No Drawings

PRECIPITATION-HARDENABLE, NITRIDED ALUMINUM ALLOYS AND NITRIDED MOTHER ALLOYS THEREFOR

BACKGROUND OF THE INVENTION

1. Field of the Invention

This invention relates to precipitation-hardenable aluminum alloys, and, particularly, to nitrided aluminum alloys having a high tensile-strength and high hardness as well as to the mother alloys therefor, and to the process for manufacturing these alloys.

More specifically, this invention concerns a process for manufacturing precipitation-hardenable nitrided aluminum alloys in which process the heretofore known nitrided aluminum alloys, which have needed a temperature as high as 900° C and more for their manufacturing, are produced according to the invention through the addition of nitrided mother alloys to render possible the use of ordinary aluminum alloy melting furnaces resistant only up to about 800° C and to obtain precipitation-hardenable nitrided aluminum alloys having further improved properties and composition-uniformity.

2. Description of the Prior Art

Although the invention is useful for significantly improving properties of not only the nitrided alloys based upon aluminum but also the nitrided alloys based upon other metals than aluminum, the invention is particularly useful when used in the case of the nitrided alloys based upon aluminum. Therefore, the invention is described hereinbelow essentially with respect to the aluminum alloys.

Alluminum has the advantages such as low specific weight, high anticorrosion property, high anodizing property and high formability, but this metal also has some disadvantages when used as structural materials such as, for example, low tensile strength and hardness and poor abrasion resistance. For the purpose of utilizing the advantages of aluminum as described above and eliminating the disadvantages thereof as mentioned above, there have been developed a series of precipitation-hardenable alloys called "Duralumin" or "17S" in the USA such as, for example, Al — Cu — Mg alloy (JIS*No. 2000 and thereafter), Al — Mg — Si alloys (JIS No. 6000 and thereafter), or Al — Zn — Mg — Cu alloys (JIS No. 7000 and thereafter) called "Extra Super Duralumin" or "75S" in the USA. In all of these alloys, the quality can be improved by only adding suitable component elements to the aluminum metal, and the tensile strength as well as the hardness, which is substantially comparable with those of low-carbon steel materials, can be obtained by subsequent heat treatment or solution heat treatment. In fact, a Duralumin such as JIS 7075 - $T_6$ has a tensile strength near to that of JIS S 30C structural carbon steel.

* JIS: Japanese Industrial Standards.

Physical properties of some commercial aluminum alloys under several "Industrial Standards" are shown in Table 1. For the comparison purpose, the data on the alloys obtained in the following Examples 1 and 2 in accordance with the present invention are also shown in Table 1.

TABLE 1

| | | Tensile Strength kg/mm² | Yield Strength kg/mm² | Elon-ga-tion % | Hardness HmV |
|---|---|---|---|---|---|
| JIS* | 7075 $T_6$** (Aluminum alloy) | 57 | 51 | 7 | Ca.180 |
| JIS | S 30C (Carbon steel) | 55 | 34 | 23 | — |
| JIS | S 40C (Carbon steel) | 58 | 40 | 22 | — |
| ISO* | AlZn6MgCu | 55.5 | 50.0 | 7 | — |
| AA* | 7075 - $T_6$** | 58.5 | 51.5 | 11 | — |
| DIN* | AlZnMgCu0.5 | 50 | 43 | 7 | — |
| | AlZnMgCu1.5 | 53 | 47 | 7 | — |
| CSA* | ZG 62 - $T_6$ | 57 | 51.5 | 7 | — |
| Example 1 | | 70 | — | 10 | 230 |
| Example 2 | | 65.5 | — | 10.7 | 230 |

Note
*JIS: Japan
ISO: International
AA: The United States of America
DLN: Germany
CSA: Canada
**The $T_6$ -treatment comprises solution heating and precipitation treatment for maximum strength as shown in American Aluminum Association Aluminum Standards and Data 1972 - 1973, page 9, and particularly the solution heating was at ca. 450° C and the precipitation treatment was at ca. 120° C.

The compositions in % of these aluminum alloys listed in Table 1 are shown in Table 1 bis.

TABLE 1 bis

| | Present* Invention | Patent** 728,024 | JIS 7075 | ISO AlZn6MgCu | AA 7075 | DIN AlZnMgCu1.5 | DIN AlZnMgCu0.5 | CSA ZG62 |
|---|---|---|---|---|---|---|---|---|
| Zn | 3.2 - 8.0 | 3.2 - 8.0 | 5.1 - 6.1 | 5.1 - 6.4 | 5.1 - 6.1 | 5.1 - 6.1 | 4.3 - 5.2 | 5.1 - 6.1 |
| Mg | 1.2 - 4.5 | 1.2 - 4.5 | 2.1 - 2.9 | 2.1 - 2.9 | 2.1 - 2.9 | 2.1 - 2.9 | 2.6 - 3.6 | 2.1 - 2.9 |
| Cu | 0.1 - 1.0 | 0.3 - 1.5 | 1.2 - 2.0 | 1.2 - 2.0 | 1.2 - 2.0 | 1.2 - 2.0 | 0.5 - 1.0 | 1.2 - 2.0 |
| Cr | 0.1 - 0.5 | 0.1 - 0.5 | 0.18 - 0.35 | 0.1 - 0.35 | 0.18 - 0.35 | 0.18 - 0.3 | 0.1 - 0.3 | 0.18 - 0.35 |
| Zr or | | Zr | Ti | Ti + Zn | | | | |
| Ti | 0.01 - 1.2 | 0.05 - 1.2 | 0.2 | 0.3 | 0.2 | 0.2 | 0.2 | 0.2 |
| Fe | — | 0.2 - 1.2 | 0.5 | 0.5 | 0.5 | 0.5 | 0.5 | 0.5 |
| Si | — | 0.05 - 0.85 | 0.4 | 0.4 | 0.4 | 0.5 | 0.5 | 0.4 |
| Ni or | | | | Ni | | | | |
| Co | 0.2 - 1.2 | 0.2 - 1.2 | — | 0.1 | — | — | — | — |
| | | | | Mn + Cr | | | | |
| Mn | — | 0.1 - 1.2 | 0.3 | 0.5 | 0.3 | - 0.3 | 0 - 0.4 | 0.3 |
| Be | 0.02 - 1.0 | 0.02 - 1.0 | — | | | | | |
| B | 0.005 - 0.2 | 0.005 - 0.2 | — | | | | | |

*The data from Table 5 to follow.
**Japanese Patent No. 728,024 which is referred to hereinbelow.

However, along with the development of industry, an aluminum alloy having a higher strength and a lower specific gravity is desired, and various means for satisfying this desire have been attempted. For example, there has been recently developed a process for producing high-tensile strength, high-hardness aluminum alloys by using a high-temperature nitriding process, such as described in Japanese Patent No. 621,486 and No. 728,028. (Japanese Patent Publication Nos. 11411/1971 and 31807/1973, respectively.)

The high-tensile strength, high-hardness aluminum alloy as mentioned above (referred to hereinbelow as "the prior nitrided aluminum alloys") has a tensile strength of over 70 kg/mm² and a Vickers hardness over 220, but it has disadvantages such as low ductility (referred to hereinbelow as "extrusion property") and low anodizing property.

Further, since the nitriding process in the manufacture of "the prior nitride aluminum alloys" is carried out by blowing nitrogen or ammonia into the melt, which is in a total quantity to be nitrided, at a temperature as high as 900° C – 1300° C, this temperature range exceeds the normal heat resistance of 800° C for standard aluminum alloy melting furnaces. Consequently, the process of the "prior nitrided aluminum alloys" can not be practiced in the usual metallurgical works. Nitriding treatment of a large quantity of alloy in a special large-sized and expensive high-temperature furnace requires very careful process control and furnace maintenance, large fuel consumption, and, thus, increased manufacturing costs for the alloy produced.

SUMMARY OF THE INVENTION

As a result of our research for improving the "prior nitrided aluminum alloys" having the defects as mentioned above, we have succeeded in eliminating these defects and in producing a precipitation-hardenable nitrided aluminum alloy having properties considerably higher than those of prior art nitrided aluminum alloys.

More specifically, this invention has as its object to provide a process for manufacturing high tensile strength, high hardness, nitrided aluminum alloys having excellent extrusion and anodizing properties and a nitrided mother alloy for the same.

Another object of the invention is to provide a process for producing the desired nitrided aluminum alloys, which process can economize manufacturing costs and heat-energy and is adaptable for mass production by producing only a small amount of nitrided mother alloy in the nitriding treatment furnace requiring high-temperature resistance and, subsequently, by treating the mother alloy, thus obtained, to provide the desired nitrided aluminum alloy in standard aluminum melting furnaces. A further object is to provide a high-quality nitrided aluminum alloy showing no segregation, having a uniform composition and a fine structure owing to the repeated melting steps.

Other aspects, objects and the several advantages of the invention will be apparent from a study of the following disclosure and the appended claims.

In one aspect, the invention encompasses a nitrided mother alloy to be contained in precipitation-hardenable, nitrided aluminum alloys, wherein said mother alloy essentially contains at least one metal selected from the group consisting of titanium, vanadium, chromium, manganese, iron, cobalt, nickel, zirconium, molybdenum, hafnium, beryllium, boron, silicon, copper, zinc, magnesium, and aluminum, which mother alloy has been nitrided at 800° C to 1200° C in its molten state.

In another aspect, the invention encompasses another nitrided mother alloy to be contained in precipitation-hardenable, nitrided aluminum alloys, wherein said mother alloy essentially contains at least one metal (X) selected from the group consisting of titanium, vanadium, chromium, manganese, iron, cobalt, nickel, zirconium, molybdenum, hafnium, beryllium, boron, aluminum, and alloys thereof and the other component (Y) being at least one metal selected from the group consisting of copper, magnesium, zinc, silicon and aluminum, which mother alloy has been produced by nitriding an alloy of the component X at 800° C to 1200° C in its molten state and then alloying these with the component Y at a temperature lower than the nitriding temperature, preferably lower than 800° C.

In still another aspect, the invention encompasses still another nitrided mother alloy to be contained in precipitation-hardenable, nitrided aluminum alloys, wherein said nitrided mother alloy essentially contains at least one metal selected from the group consisting of titanium, vanadium, chromium, manganese, iron, cobalt, nickel, zirconium, molybdenum, hafnium, beryllium, boron, and aluminum, which mother alloy has been nitrided at 800° C to 1200° C in its molten state.

In a further aspect, the invention encompasses a precipitation-hardenable, nitrided aluminum alloy which contains the above-mentioned first or second mother alloy and aluminum with, if necessary, additional desirable components to make up the precipitation-hardenable, nitrided aluminum alloy.

In still a further aspect, the invention encompasses a precipitation-hardenable, nitrided aluminum alloy which contains the above-mentioned third mother alloy, and at least one metal selected from the group consisting of copper, magnesium, zinc, silicon and aluminum with, if necessary, additional desirable components to make up the precipitation-hardenable, nitrided aluminum alloy.

It must be noted in constuing the present invention that the constituent "metal" can be in the form of an alloy of at least two of the metals listed. In order words, the term "metal" includes "alloy". See Hackh's CHEMICAL DICTIONARY 4thEd. McGraw-Hill Book Co. Furthermore, the term "metal" includes "silicon".

PREFERRED EMBODIMENTS OF THE INVENTION

In accordance with the present invention, mother alloys are first produced, and then alloyed with aluminum metal to produce precipitation-hardenable, nitrided alloys.

The precipitation-hardenable, nitrided aluminum alloys according to the present invention, which have been "nitrided" by incorporation of nitrided mother alloys, have improved ductility or extrusion properties at a copper content as low as 0.5% in comparison with the usual copper content of 1.5% for the "prior nitrided aluminum alloys", and, accordingly, have improved anodizing properties due to the lower copper content. The nitrided aluminum alloys according to the invention also have improved tensile strength.

The nitrided mother alloys, in accordance with the present invention, are classified into three types.

The first, which is prepared in one step, is, in a preferred embodiment, a "one-package" type mother alloy in that the components to be incorporated into the precipitation-hardenable, nitrided aluminum alloy are contained in said mother alloy and thus can be alloyed with aluminum metal by means of a conventional alloying furnace for aluminum at maximum temperatures of about 800° C. The second is also a one-package type mother alloy, although preparation thereof is carried out in two steps. It should be noted, however, that the nitrided mother alloys of these two classes are not necessarily of the "one-package" type and that each of these mother alloys may contain only one of the components listed above.

The third is not of the one-package type in that some additional components, namely at least one metal selected from the group consisting of copper, zinc, magnesium, silicon and aluminum, are necessary to make up precipitation-hardenable, nitrided aluminum alloys.

In any of the mother alloys, it is preferable that they contain aluminum, since they are eventually incorporated into precipitation-hardenable, nitrided aluminum alloys.

The process for producing the nitrided mother alloys according to the invention is described hereinbelow. One or more metals selected from the group consisting of Ti, V, Cr, Mn, Fe, Co, Ni, Zr, Mo, Hf (each of them being a transition metal), Be, B, Si, Cu, Zn, Mg, and Al, are melted as an elemental metal or as an alloy thereof, and while the melt is maintained at a temperature of from 800° C to 1200° C, a nitriding agent, preferably a gaseous agent such as molecular nitrogen or easily decomposable nitrogenous gas, particularly non-oxidizing nitrogen compounds, such as ammonia, or mixtures thereof, is introduced into the melt by means of a tuyere of refractory material. The nitriding treatment is thus carried out in the presence of the stirring effect of the bubbling nitriding agent to obtain the desired nitrided mother alloy. The quantity of nitrogen gas to be introduced during the treatment is in the range of from 0.5 to 5 liters, preferably 1 to 3 liters, and most preferably about 2 liters per 1 kg of the melt, while the time period of introduction of nitrogen gas is in the range of from 0.5 to 5 hours, preferably 1 to 3 hours, and most preferably about 2 hours.

Although it is preferable to use a gaseous nitriding agent, particularly those which are non-oxidizing, nitriding agents having a non-gaseous form may also be employed, for example, inorganic salts such as ammonium salts and nitrates. Further, organic nitrogenous compounds such as amines can also be used if desired.

The nitrided mother alloy thus obtained is called hereinbelow "mother alloy A". The mother alloy A may or may not contain Cu, Zn, Mg, Si, and/or Al which may be added thereto for the purpose of obtaining the nitrided mother alloy "B". Usually, however, the mother alloy A does not contain these elements.

The nitrided mother alloy A can be supplied to the market as is, or it can be added to aluminum metal together with a plurality of members selected from the group consisting of Cu, Zn, Mg, Si and Al to obtain precipitation-hardenable, nitrided aluminum alloys. Alternatively, the nitrided mother alloy A can be maintained below the above mentioned nitriding temperature, and then at least one element selected from the group consisting of Cu, Zn, Mg, Si, and Al is added thereto and melted therewith to form the nitrided mother alloy B.

Either of the above-described nitrided mother alloys A or B can be cast into ingots which can be, in turn, supplied to the usual metallurgical works.

The metallurgical works which have received the nitrided mother alloy A or B, add, for example, the elements Si, Cu, Zn, Mg, and/or Al together with the nitrided mother alloy A to aluminum metal, melt and maintain a normal temperature for metallurgical treatment, the quantity of these metals being sufficient to obtain a final content in the resulting aluminum alloy product to form ingots. It is also possible to add only the nitrided mother alloy B to aluminum metal in amounts sufficient to obtain a final content in the resulting product and melt and maintain the product at normal alloying temperatures, for example up to 750° C, or up to 700° C to produce a melt and form ingots.

After homogenizing heat treatment of the ingot at ca, 450° C, hot working treatment such as extrusion, rolling or drawing at Ca. 300° to 400° C, and cold working treatment such as drawing, rolling or die-forging at ambient temperature, the aluminum alloy thus obtained is subjected to the so-called T6 treatment which comprises, as shown in Table 1, solution heat treatment and artificial age-hardening treatment to form an aluminum-based nitrided alloy having the strength and hardness desired for practical use. See Kirk and Othmer *Encyclopedia of Chemical Technology* Vol.1 pp. 968 to 971, Second Ed. completely revised, John Wiley and Sons, Inc. 1963 for further information on aluminum alloy treatments.

The contents of respective components other than Al to the contained in the mother alloys according to the invention are from 2 to 10 times, preferably from 2 to 5 times as high as those of said respective components contained in the precipitation-hardenable, nitrided aluminum alloys to be produced by introducing the mother alloys thereto.

The preferable contents of respective components which can be contained in the precipitation-hardenable, nitrided aluminum alloys are shown in the following Table 2:

TABLE 2

| | |
|---|---|
| Zinc | 3.2 - 8.0% |
| Magnesium | 1.2 - 4.5 |
| Copper | 0.1 - 1.5 |
| Nickel or cobalt | 0.2 - 1.2 |
| Chromium | 0.1 - 0.5 |
| Zirconium and/or titanium | 0.01 - 1.2 |
| Beryllium | 0.02 - 1.0 |
| Manganese | 0.1 - 1.2 |
| Vanadium | 0.01 - 1.2 |
| Molybdenum | 0.01 - 1.2 |
| Boron | 0.005 - 0.2 |
| Aluminum | Balance |

EXAMPLE 1

An example is given in which an aluminum alloy classified in the composition range of the above mentioned alloy and having a final composition as listed in the following Table 3 is produced according to the process of the present invention:

TABLE 3

| FINAL COMPOSITION (%) | | | | | | | | |
|---|---|---|---|---|---|---|---|---|
| Zn | Mg | Cu | Cr | Ni | Zr | Be | B | Al |
| 5.6 | 2.8 | 1.5 | 0.2 | 0.25 | 0.55 | 0.025 | 0.02 | Balance |

0.4 kg of mother alloy Al — Cr containing 3% of Cr, 0.66 kg of mother alloy Al — Zr containing 5% of Zr, 0.03 kg of mother alloy Al — Be containing 5% of Be, 0.04 kg of mother alloy Al — B containing 3% of B, and 0.15 kg of mother alloy Al — Ni containing 10% of Ni are melted together in a crucible of refractory graphite, and the temperature of the resulting melt is maintained at 800° C to 1200° C. Cylinder nitrogen gas is blown into the melt by means of a tuyere of refractory material with the ratio of 2 liters of nitrogen gas per 1 kg of melt, and the nitriding treatment is carried out for about two hours under the stirring action caused by the bubbling nitrogen, to obtain a nitrided mother alloy A for aluminum-based nitrided alloys.

Next, while the nitrided mother alloy A is maintained at a temperature range of 800° C to 1200° C, 0.27 kg of a mother alloy Al - Cu containing 33% of Cu is added thereto and melted therewith, and thereafter the temperature of the resulting melt is lowered to 800° C. Then, 0.336 kg of 100% Zn and 0.168 kg of 100% Mg are added thereto and melted therewith to obtain a nitrided mother alloy B for aluminum-based nitrided alloys.

The mother alloy B thus obtained has the composition as shown in the following Table 4, in which composition, the contents of respective component metals are about three times larger than those of the above mentioned preferable final composition (%):

TABLE 4

| Zn | Mg | Cu | Cr | Ni | Zr | Be | B |
|---|---|---|---|---|---|---|---|
| 16.4 | 8.18 | 4.34 | 0.58 | 0.73 | 1.61 | 0.073 | 0.058 |

Manufacturing of the aluminum-based nitrided alloy of the above mentioned preferably final composition by the use of the nitrided mother alloy B is carried out by melting 3.946 kg of 99.9% Al metal at 750° C and by adding 2.054 kg of the mother alloy B into the resulting Al melt for melting therewith and casting the melt thus obtained into an ingot.

When the aluminum-based nitrided alloy obtained in this example has been subjected to a T6 treatment (refer to Table 1), the resulting product has 70 kg/mm$^2$ of tensile strength, 10% of elongation, and 230 of Hmv hardness, which means that it has about 20% higher tensile strength, about 25% higher hardness, and about 40% higher elongation in comparison with the aluminum-based alloy under JIS 7075 — T6. Thus, an aluminum-based nitrided alloy having excellent properties for structural material which are comparable to those of the carbon steel under JIS S 40 C (refer to Table 1) for mechanical structure is obtained according to the invention.

The present invention will now be explained in some more detail in terms of more preferable embodiments.

In general, the precipitation-hardenable, nitrided aluminum alloys obtained in accordance with the present invention have high strength and high hardness inherent to the "prior nitrided aluminum alloys" according to Japanese Patent Nos. 621,486 and 728,028, while at the same time, the poor extrusion property and the poor anodizability of the "prior nitrided aluminum alloys" are eliminated according to the present invention. This feature of the precipitation-hardenable, nitrided aluminum alloys of the present invention becomes most remarkable when they have a specific composition.

This specific composition in shown in the following Table 5 together with compositions of a "prior nitrided aluminum alloy" (Japanese Patent No. 728,024), the aluminum alloy in accordance with JIS 7075, and ISO $AlZn_6MgCu$ alloy:

TABLE 5

| | Present Invention | Japanese Pat. No. 728,024 | JIS 7075 | ISO $AlZn_6MgCu$ |
|---|---|---|---|---|
| Zn | 3.2 - 8.0% | 3.2 - 8.0% | 5.1 - 6.1% | 5.1 - 6.4% |
| Mg | 1.2 - 4.5 | 1.2 - 4.5 | 2.1 - 2.9 | 2.1 - 2.9 |
| Cu | 0.1 - 1.0 | 0.3 - 1.5 | 1.2 - 2.0 | 1.2 - 2.0 |
| Cr | 0.1 - 0.5 | 0.1 - 0.5 | 0.18 - 0.35 | 0.1 - 0.35 |
| Zr and/ Ti or | 0.01 -1.2 Zr | 0.05-1.2 Ti | 0.20 | 0.3 |
| Fe | — | 0.2 - 1.2 | 0.50 | 0.5 |
| Si | — | 0.05 - 0.85 | 0.40 | 0.4 |
| Ni or Co | 0.2 - 1.2 | 0.2 - 1.2 | — | 0.1 |
| Mn | — | 0.1 - 1.2 | 0.30 | 0.3 |
| Be | 0.02 - 1.0 | 0.02 - 1.0 | — | — |
| B | 0.005 - 0.2 | 0.005 - 0.2 | — | — |

The reason why the contents of respective components of the preferable alloys according to the present invention are limited within the ranges as shown in the above Table 5 is described hereinbelow.

The range of 3.2 - 8.0% for Zn and that of 1.2 - 4.5% for Mg can accelerate age-hardening effects and contribute to increased strength due to the production of $MgZn_2$. Below the lower limit of the respective ranges, age-hardening and strengthening effects become insufficient, while above the upper limit of respective ranges, workability and corrosion resistance become inferior. The range of 0.1 - 1.0% for Cu contributes to age-hardening and increased strength, but above the upper limit thereof, corrosion resistance of the alloys is considerably decreased, and at the same time, adaptability in surface treatments such as anodizing treatment is also remarkably decreased.

The addition of Ni and/or Co, which are transition metals of the 4th period, in the range of 0.2 - 1.2% contributes to strengthening of the grain boundary and increasing work-hardening, because the solubility thereof in aluminum metal is low and there is produced intermetallic compounds which are concentrated in the vicinity of the grain boundary to increase the transition density. However, above the upper limit 1.2%, workability of the alloys is decreased, while below the lower limit 0.2%, the desired effects of the addition of these metals are not fully exhibited. The use in the range of 0.01 - 1.2% for Zr and/or Ti and 0.005 - 0.2% for B serves to form nitrides of the metals through the nitriding treatment, and the nitrides thus produced which are finely dispersed in the alloy impede the shift of the transition line due to any sliding deformation, which results in the effect of strengthening the dispersion, rendering the crystal grain finer and preventing cracks. However, Zr and its group metals have no effect below the lower level of the above-mentioned range, and decrease the workability of the alloys or cause embrittlement.

Cr which is also a transition metal of the 4th period serves to prevent the embrittlement of the grain boundary and to increase the corrosion resistance through the formation of fine crystal grains. This metal is effective in preventing grain boundary corrosion and stress corrosion when present in an amount of 0.1%, but results in decreased workability above amounts of 0.5%.

Similarly to Zr or B, the range of 0.02 - 1.0% for Be serves to form nitrides thereof, and contributes to increased hardness and strength.

Although the incorporation of Fe and Si in the aluminum-based alloys is effective with respect to work-hardening, it decreases the workability and surface treatment adaptability, and, at the same time, the skin surface of the final product becomes inferior. Mn has significant disadvantageous effects against machinability. Accordingly, these metals are not included in the preferable composition mentioned above.

The manufacturing process for producing the mother alloy (referred to hereinbelow as mother alloy A') suitable for manufacturing the above mentioned preferable high-tensile-strength aluminum alloys is described. Cr, Zr and/or Ti, Ni or Co, Be, B and Al, or alternatively, Cr, Zr and/or Ti, Ni or Co, Be, B, Al, and at least one of Zn, Mg and Cu are alloyed to prepare a melt, the amount of the metals other than Al being 2 - 10 times as large as those of the final composition, and the temperature of the melt is maintained at 800° C to 1200° C. Cylinder nitrogen gas or nitrogen-containing gas is introduced into the melt by means of a tuyere of refractory meterial at the rate of 2 liters of gas per 1 kg of melt. After the nitriding treatment under the stirring effects through bubbling of the nitriding gas, the melt is cast into ingots to obtain mother alloy A'. This mother alloy A' can be supplied to the market as is just as in the case of the above mentioned mother alloy A.

The ingot of the above mother alloy A' can be melted and maintained at the temperature of 800° C, and at least one of Cu, Zn or Mg is added thereto in amounts of 2 – 10 times the amounts found in the desired final composition to cast ingots, which melt can be used at the mother alloy B' for providing high-tensile-strength aluminum alloys. The mother alloy B' can be produced directly from mother alloy A' without the step of forming ingots of mother alloy A'.

In manufacturing the high-tensile-strength aluminum alloy according to the invention, a quantity of aluminum metal is employed which will correspond to its content in the final product and is melted and maintained at the temperature range of 750° to 800° C. Quantities of Cu, Zn or Mg are similarly employed which will correspond to their respective contents in the final product and are added to the aluminum melt obtained as above together with the above mentioned mother alloy A', and the resulting melt is cast into ingots. In a similar manner, another quantity of aluminum metal is employed which corresponds to its content in the final product and is melted and maintained at a temperature of 750° C, and the above mentioned mother alloy B' is added to the melt to cast the resulting melt into ingots.

The high-tensile-strength aluminum alloy thus obtained is subjected to a soaking treatment at around 450° C for about 20 hours, and after hot working or cold working, is further subjected to so called T6 treatment (refer to Table 1) consisting of solution heat treatment at the temperature of 450°– 490° C, quenching, high-temperature age-hardening temperatures of 85° – 130° C, whereby alloys which can be used in practice are obtained.

EXAMPLE 2

In this example, the manufacturing process of preferable precipitation-hardenable, nitrided aluminum alloys is described.

First, 0.174 kg of 99.9% Al is melted, and 0.047 kg of mother alloy Al — Be containing 5% of Be, 0.060 kg of mother alloy Al — B containing 3% of B, 0.989 kg of mother alloy Al — Zr containing 5% of Zr, 0.225 kg of mother alloy Al — Ni containing 10% of Ni, and 0.598 kg of mother alloy Al — Cr containing 3% of Cr are added to the aluminum melt, and the resulting melt is maintained at the temperature of 850° to 1100° C. Nitrogen gas is bubbled into the melt for two hours by means of a tuyere of refractory material at the rate of two liters of nitrogen gas per 1 kg of melt. The nitriding treatment is conducted under the stirring effects of the bubbling nitrogen gas to obtain mother alloy A'. While the temperature of the mother alloy A' is maintained at 800° C, 0.133 kg of mother alloy Al — Cu containing 33% of Cu, 0.508 kg of 100% Zn, and 0.252 kg of 100% Mg are introduced into the melt to form mother alloy B', and the resulting melt is cast into ingots.

In this example, component metals other than Cu, Zn, Mg and Al in the mother alloy A' are present in amounts which are about three times larger than corresponding amounts present in the final composition, while component metals other than Al in the mother alloy B' are present in amounts which are about three times larger than corresponding amounts present in the final composition.

Next, a quantity of 99.9% Al is melted, and the resulting melt is maintained at a temperature of 750° C. The ingots of the above mentioned alloy B' are cut into pieces and added to the melt to form a further melt, which is cast into an ingot. After T6 treatment of the latter ingot, there is obtained 7.8 kg of high-tensile-strength aluminum alloy having the composition(%) and properties as mentioned below:

TABLE 6

| Zn | Mg | Cu | Cr | Ni | Zr | Be | B |
|---|---|---|---|---|---|---|---|
| 5.6 | 2.8 | 0.5 | 0.2 | 0.25 | 0.55 | 0.025 | 0.02 |

The final alloy obtained after T6 treatment had properties of a tensile-strength of 65.5 kg/mm$^2$, elongation of 10.7%, and an Hmv hardness of 230, which indicates that the tensile strength is increased by about 15%, the elongation is increased by about 50%, and the hardness is increased by about 25% respectively in comparison with the above mentioned alloy under JIS 7075 of Table 1. The tensile strength is comparable to that of low — or medium carbon high strength steel. The alloy also has good workability and corrosion resistance and excellent abrasion resistance. As is apparent from comparison of Table 4 with Table 6, the alloy of Example 2 is distinct from that of Example 1 in its lower copper content. The lower copper content will lead to improved anodizability of the alloy of Example 2.

Although this example relates to the process of the present invention for manufacturing aluminum-based nitrided alloys containing 8 kinds of component metals and the nitrided mother alloys for said aluminum-based nitrided alloys, the present invention is not limited thereto, but it can be similarly applied to the process for manufacturing the nitrided alloys containing transition metals and one or more component metals selected from the group consisting of Be, B, Si and Cu and the nitrated mother alloys for the same nitrided mother alloys.

Further, by using the nitrided mother alloy containing a few of the component metals manufactured by the process according to the invention, and by adding thereto a plurality of other metals, a nitrided alloy containing a large number of component metals and having the desired properties can be obtained.

As is clear from the above description, according to the invention, by using a nitrided mother alloy which has been subjected to the nitriding treatment in a small-sized, high-temperature melting furnace, a desirable nitrided alloy can be readily produced at low temperatures in a low-temperature metallurgical furnace, and the nitrided alloy thus produced has excellent properties in comparison with the prior art alloys. Therefore, alloys can be produced by means of standard procedures which are not complicated and very economical, and provides an additional advantage with respect to energy-saving.

As described above, the high-tensile-strength aluminum alloys according to the invention have superior properties for structural materials when compared with prior aluminum alloys. The particularly important feature of the present aluminum alloys is that they are alloys based upon the above described mother alloys A and B. Owing to this feature, only small-sized furnaces are required for the high-temperature nitriding treatment, and presently available furnaces for producing standard aluminum alloys are sufficient for producing the alloys of the final composition. Consequently, the furnace for preparing mother alloys does not require a large area, can be purchased at low cost, requires low fuel cost, and is equipped for standard maintenance and control, so that the mother alloys can be produced at very low costs. Even industries which have only conventional furnaces can readily produce the high-tensile-strength aluminum alloys according to the invention, since they need only be supplied with the mother alloys.

In general, nitrided alloys have the characteristic of providing greatly increased hardness and tensile strength, and this is presumably due to the improved internal strain thereof. However, this characteristic has also caused the tendency toward segregation, and castings made therefrom have been prone to cracking, so that it has heretofore been difficult to produce good products with high efficiency.

On the other hand, in the manufacturing process according to the invention, some of the melting steps are repeated one after the other, and stirring of the melt is effectively carried out by the bubbling action of nitrogen gas introduced into the melt, or the melting steps are carried out at varying temperatures, so that not only is segregation minimized, but also cracking in the casting process is prevented. Therefore, continuous casting which has heretofore been difficult is rendered possible, and the desired uniformity of composition and fine structure are obtained to produce the nitrided alloys having excellent properties.

What is claimed is:

1. A process for producing a nitrided mother alloy to be used in preparing a final composition which is a precipitation-hardenable, nitrided aluminum alloy which nitrided aluminum alloy consists essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron, and the remainder aluminum, the process comprising the steps of alloying metals selected from the group consisting of (1) chromium, zirconium and/or titanium, nickel or cobalt, beryllium, boron and aluminum, and (2) chrominum, zirconium and/or titanium, nickel or cobalt, beryllium boron, aluminum and at least one selected from the group consisting of zinc, magnesium and copper, the amount of the metals other than aluminum being 2 to 10 times larger than that desired in the final composition, and blowing a nitriding gas selected from the group consisting of molecular nitrogen, decomposable nitrogenous gases and mixtures thereof into the molten alloy having a temperature of 800° C to 1200° C to produce the nitrided mother alloy.

2. The process according to claim 1, wherein following the nitriding at a temperature of 800° C to 1200° C at least one of the metals of copper, magnesium and zinc which is absent in the mother alloy is further alloyed with the mother alloy at a temperature not higher than said nitriding temperature, said at least one of the metals of copper, magnesium and zinc being present in the alloy in amounts of 2 to 10 times larger than that desired in the final compositon.

3. A process for producing a precipitation-hardenable, nitrided aluminum alloy, the alloy consisting essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron and the remainder aluminum, the process comprising the step of alloying aluminum metal with a nitrided mother alloy produced by the process of claim 1 and at least one of the metals of copper, magnesium and zinc which is absent in the nitrided mother alloy.

4. A process for producing a precipitation-hardenable, nitrided aluminum alloy, the alloy consisting essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron and the remainder aluminum, the process comprising alloying aluminum metal with a nitrided mother alloy produced by the process of claim 2.

5. A nitrided mother alloy to be used in preparing a final composition which is a precipitation-hardenable, nitrided aluminum alloy which nitrided aluminum alloy consists essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron, and the remainder aluminum, the amount of the metals other than aluminum in the nitrided mother alloy being 2 to 10 times larger than that desired in the final composition, said mother alloy having been produced by alloying metals selected from the group consisting of (1) chromium, zirconium and/or titanium, nickel or cobalt, beryllium, boron and aluminum, and (2) chromium, zirconium and/or titanium, nickel or cobalt, beryllium, boron, aluminum and at least one selected from the group consisting of zinc, magnesium and copper, the amount of the metals other than aluminum being 2 to 10 times larger than that desired in the final composition, and blowing a nitriding gas selected from the group consisting of molecular nitrogen, decomposable nitrogenous gases and mixtures thereof into the molten alloy having a temperature of 800° C to 1200° C to produce the nitrided mother alloy.

6. A nitrided mother alloy to be used in preparing a final composition which is a precipitation-hardenable, nitrided aluminum alloy which nitrided aluminum alloy consists essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron, and the remainder aluminum, the amount of the metals other than aluminum in the nitrided mother alloy being 2 to 10 times larger than that desired in the final composition, said mother alloy having been produced by alloying metals selected from the group consisting of (1) chromium, zirconium and/or titanium, nickel or cobalt, beryllium, boron and aluminum, and (2) chromium, zirconium and/or titanium, nickel or cobalt, beryllium, boron, aluminum and at least one selected from the group consisting of zinc, magnesium and copper, the amount of the metals other than aluminum being 2 to 10 times larger than that desired in the final composition, and blowing a nitriding gas selected from the group consisting of molecular nitrogen, decomposable nitrogenous gases and mixtures thereof into the molten alloy having a temperature of 800° C to 1200° C to produce the nitrided mother alloy and further alloying therewith at least one of the metals of copper, magnesium and zinc which is absent in the metal (1) or (2) at a temperature not higher than the nitriding temperature, at least one of the metals of copper, magnesium and zinc being present in the mother alloy in amounts of 2 to 10 times larger than that desired in the final composition.

7. A precipitation-hardenable, nitrided aluminum alloy, the alloy consisting essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron and the remainder aluminum, the alloy having been produced by alloying aluminum metal with a nitrided mother alloy of claim 5 and at least one of the metals of copper, magnesium and zinc which is absent in the nitrided mother alloy.

8. A precipitation-hardenable, nitrided aluminum alloy, the alloy consisting essentially of 3.2 to 8.0% of zinc, 1.2 to 4.5% of magnesium, 0.1 to 1.0% of copper, 0.1 to 0.5% of chromium, 0.01 to 1.2% of zirconium and/or titanium, 0.2 to 1.2% of nickel or cobalt, 0.02 to 1.0% of beryllium, 0.005 to 0.2% of boron and the remainder aluminum, the alloy having been produced by alloying aluminum metal with a nitrided mother alloy of claim 6.

* * * * *